US006006570A

United States Patent [19]

Kümmerling et al.

[11] Patent Number: 6,006,570

[45] Date of Patent: Dec. 28, 1999

[54] METHOD AND DEVICE FOR PRODUCING A HOLLOW BODY FROM SOLID ROUND STEEL

[75] Inventors: Rolf Kümmerling, Duisburg; Adolf Kindsgrab, Essen; Rolf Pieters, Mülheim, all of Germany

[73] Assignee: Mannesmann AG, Düsseldorf, Germany

[21] Appl. No.: 09/142,802

[22] PCT Filed: Mar. 7, 1997

[86] PCT No.: PCT/DE97/00507

§ 371 Date: Sep. 11, 1998

§ 102(e) Date: Sep. 11, 1998

[87] PCT Pub. No.: WO97/33707

PCT Pub. Date: Sep. 18, 1997

[30] Foreign Application Priority Data

Mar. 13, 1996 [DE] Germany ..... 196 11 782

[51] Int. Cl.[6] ..... B21B 19/04

[52] U.S. Cl. ..... 72/97

[58] Field of Search ..... 72/95, 96, 97, 72/208, 209

[56] References Cited

U.S. PATENT DOCUMENTS

| | | | |
|---|---|---|---|
| 2,535,976 | 12/1950 | Wehman | 72/97 |
| 4,803,861 | 2/1989 | Kummerling et al. | 72/97 |
| 5,406,820 | 4/1995 | Mosey | 72/97 |
| 5,479,805 | 1/1996 | Koenen et al. | 72/97 |

FOREIGN PATENT DOCUMENTS

| | | | |
|---|---|---|---|
| 57-22807 | 2/1982 | Japan | 72/97 |
| 60-64716 | 4/1985 | Japan | 72/97 |
| 61-27108 | 2/1986 | Japan | 72/97 |
| 2-121706 | 5/1990 | Japan | 72/97 |
| 3-27806 | 2/1991 | Japan | 72/97 |

*Primary Examiner*—Joseph J. Hail, II
*Assistant Examiner*—Ed Tolan
*Attorney, Agent, or Firm*—Cohen, Pontani, Lieberman & Pavane

[57] ABSTRACT

A method and a device for producing a hollow body from solid round steel that has been heated to shaping temperature by piercing in an inclined rolling mill using pass-closing guide elements. For this purpose, prior to the commencement of piercing, the clear distance between the pass-closing guide elements is reduced in comparison to that of the stationary rolling phase and, after initial rolling, the distance is adjusted to the customary value for the stationary phase. The changes in distance are effected automatically through the balancing of the forces acting on the pass-closing guide elements during the shaping of the round steel and the closing forces which keep the pass opening dimension small.

6 Claims, 2 Drawing Sheets

METHOD AND DEVICE FOR PRODUCING A HOLLOW BODY FROM SOLID ROUND STEEL

BACKGROUND OF THE INVENTION

1. Field of the Invention

The invention is directed to a method for producing a hollow body from solid round steel that has been heated to shaping temperature.

2. Discussion of the Prior Art

The basic process for producing a hollow body from solid round steel by means of inclined rolls as a preliminary step in the production of seamless pipes is known (see Stradtmann, Stahlrohr-Handbuch, 7th edition, 1973, Vulkan-Verlag, Essen). In one of the known arrangements, a two-roll inclined rolling mill with Diescher disks is used for guiding the rolling stock (DE-PS 4308721).

A uniform wall thickness in the hollow bloom or ingot has decisive importance for the distribution of the wall thickness in the finished pipe, especially the eccentricity. Ideally, this is optimal when the ingot to be pierced, or the hollow ingot formed therefrom, is located with its center axis exactly on the center axis of the rolling mill and the center axis of the piercing mandrel likewise coincides precisely with the course of the center axis of the rolling mill. Interference can bring about deviations which become noticeable as deviations from the ideal position, wherein these deviations can be divided into components in the direction of the rolls and perpendicular thereto in the direction of the guides. Ideally, deviations of the piercing mandrel are compensated by the equilibrium of forces. Deviations in the position of the initial ingot result at the start of rolling in eccentric initial piercing which, particularly in the case of thick-walled hollow bodies in which the restoring forces brought about by the force equilibrium are small, leads to noticeably one-sided wall thicknesses and accordingly to waste.

In order to prevent eccentric piercing of the kind mentioned above, it is attempted to configure the piercing operation such that, immediately after the ingot is grasped by the rolls, the guides, for example, the rotating Diescher disks, guide the ingot centrally before the end face of the ingot contacts the piercing mandrel. However, this cannot always be guaranteed due to the radius of the Diescher disks.

SUMMARY OF THE INVENTION

It is the object of the invention to provide a method for the production of a hollow body from solid round steel that has been heated to shaping temperature, by which the centering of the ingot can be ensured in a simple manner prior to the initial piercing operation, especially in the case of thick-walled hollow bodies.

According to the inventive method, immediately prior to the commencement of piercing, the clear distance between the pass-closing guides, preferably Diescher disks, is reduced in comparison to that of the stationary rolling phase. After initial rolling, the distance is adjusted to the customary value for the stationary rolling phase. The change in distance should advantageously be carried out automatically by the forces occurring in the direction of the guides (Diescher disks) during shaping.

With respect to the inventive device, the method according to the invention is realized in such a way that means which apply force to the guide so as to reduce the clear distance are arranged at the swinging or displacing arm of the pass-closing guides. These means preferably comprise a spring assembly which can be pretensioned. Alternatively, this action may be carried out by a hydraulically or pneumatically operating piston-cylinder unit which acts directly or indirectly, e.g., via an eccentric cam. The means exhibit a progressive characteristic such that the force for widening the guide clearance increases appreciably as the opening path increases, wherein the force for achieving the guide clearance under stationary conditions is less than the counterforce generated by shaping. The customary clear distance is accordingly reset automatically.

The advantage of the proposed method is that the desired centering for initial rolling is achieved by means of a very simple construction.

The method according to the invention is explained more fully in the drawing with reference to an embodiment.

DETAILED DESCRIPTION OF THE PREFERRED EMBODIMENT

Figure 1:
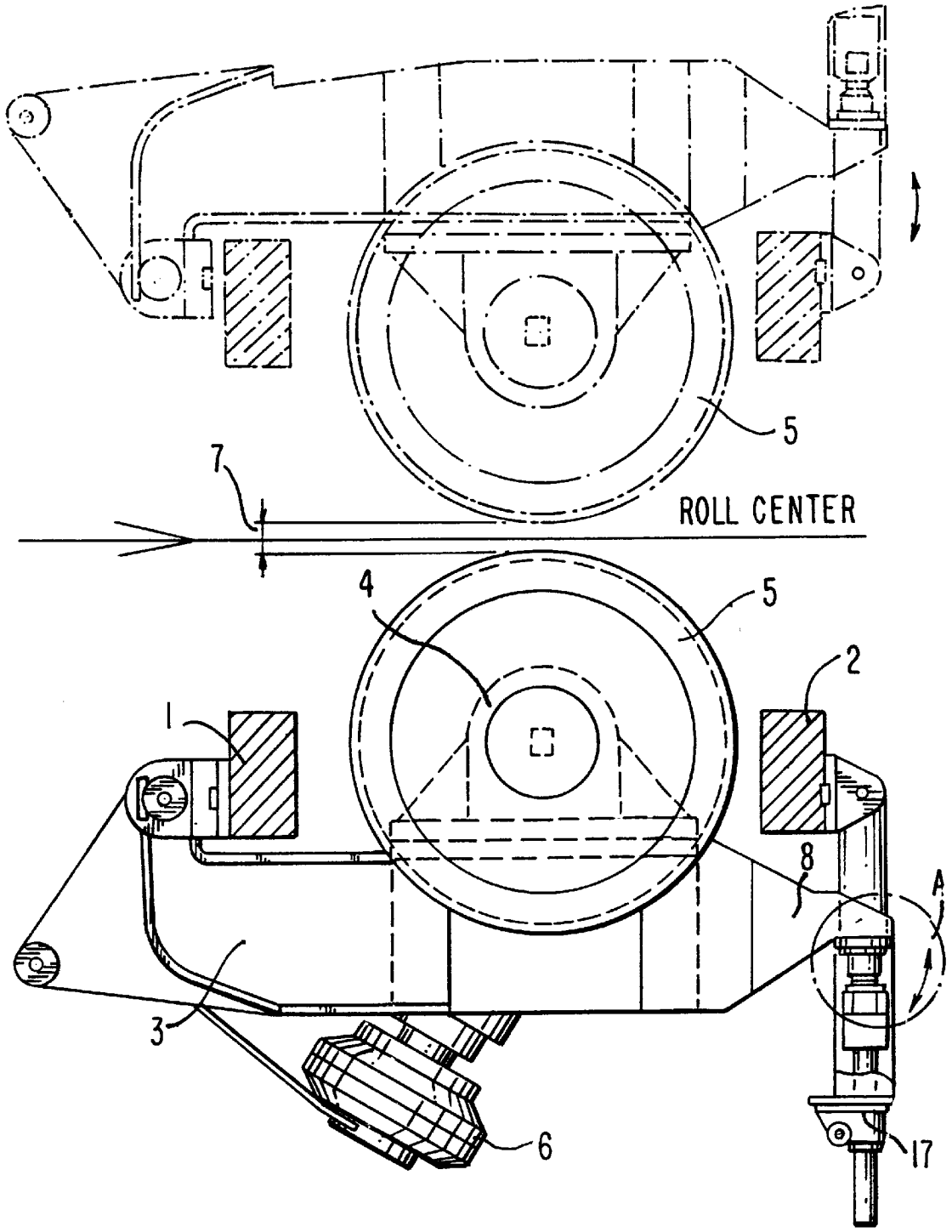
FIG. 1 shows a top view of a guide element in the guide plane.
Figure 2:
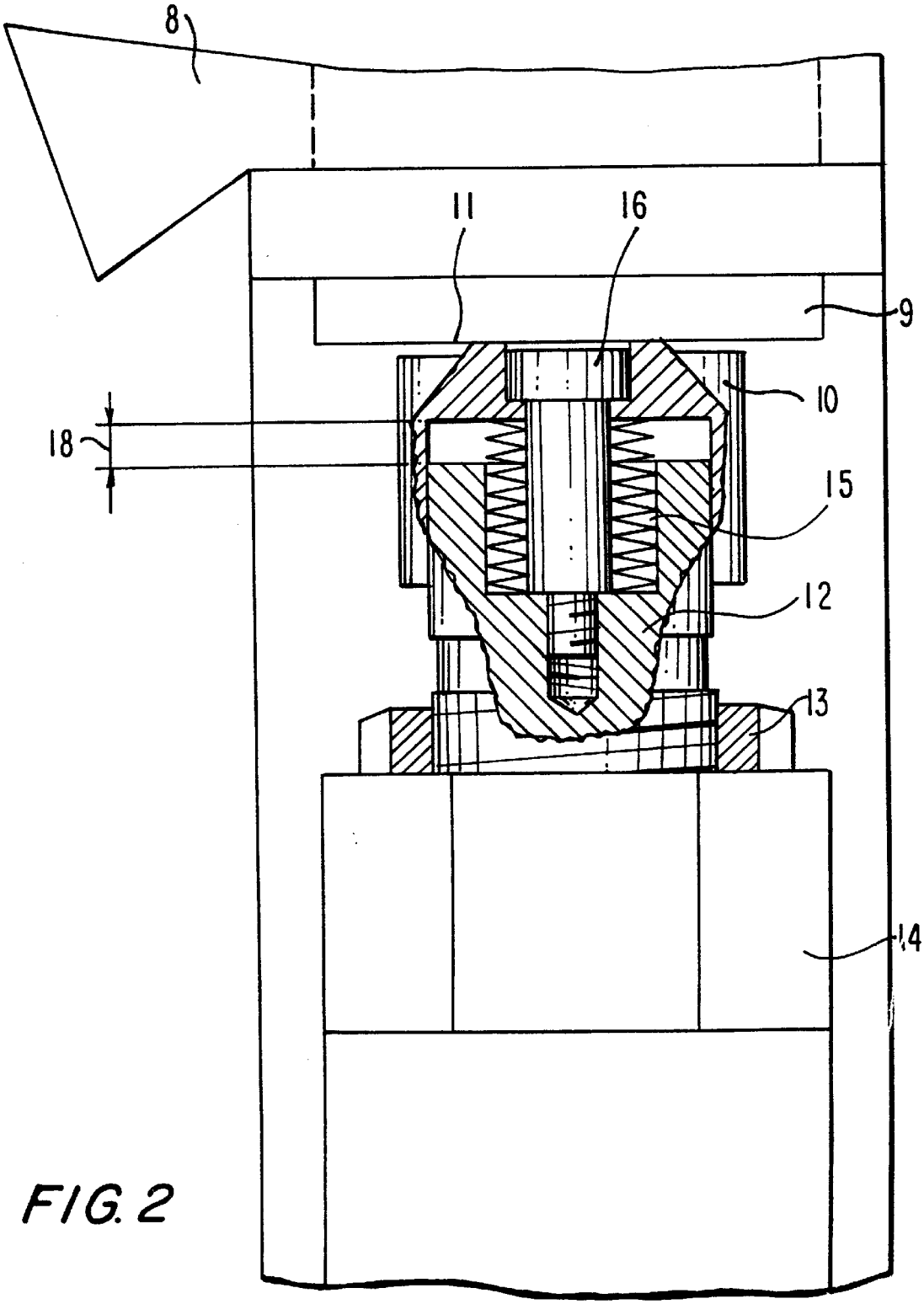
FIG. 2 is an enlarged view of detail A.

FIG. 1 shows a top view of a guide element in the guide plane and FIG. 2 is an enlarged view of detail A. The guide element 5, in this case a Diescher disk, is arranged between two stationary stands 1, 2 on a bearing block 4 by means of a rocker 3 which can pivot out. The Diescher disk 5 is driven by means of a hydraulic motor 6 arranged below the rocker 3. The adjusting mechanism for adjusting the clear distance 7 of the Diescher disk 5 is arranged at the right-hand end of the rocker 3 with reference to the drawing. The clawlike end 8 of the rocker 3 rests by a stop element 9 on the hat-shaped counterpiece 10 of the adjusting mechanism. In order to compensate for the circular movement of the clawlike end 8 of the rocker 3, the counterpiece 10 has a cup-shaped countersurface 11. A pistonlike element 12 provided with a central recess is fixedly connected with the piston rod 14 of the adjusting mechanism by means of a thread and a lock nut 13. A plate spring assembly 15, for example, which can be pretensioned by a screw 16 is arranged in the above-mentioned central recess. The adjustment of the spacing 7 of the Diescher disk 5 is carried out by means of a spindle element 17 which is indicated only schematically in FIG. 1. The travel 18 resulting from the gap between the end face of the piston-like element 12 and the inner end face of the counterpiece 10 corresponds to half of the difference between the spacing 7 of the Diescher disks 5 prior to initial rolling and the spacing 7 of the Diescher disks 5 in the stationary rolling phase.

We claim:

1. A method for producing a hollow body from a solid round steel billet that has been heated to shaping temperature in an inclined rolling mill, comprising the steps of:

guiding the billet with pass-closing guide elements;

piercing the heated steel billet using a piercing mandrel;

advancing the steel billet using inclined rolling rolls;

prior to commencement of the piercing, reducing a clear distance between the pass-closing guide elements in comparison to a distance in a stationary rolling phase;

after initial rolling, adjusting the distance to a customary value for the stationary phase; and effecting the changes in distance automatically by balancing forces acting on the pass-closing guide elements during shaping of the round steel and closing forces which keep the pass opening dimension small.

2. A device for producing a hollow body from solid round steel billet, comprising:

a two-roll inclined rolling mill;

a piercing mandrel held between the inclined rolls;

means for holding the piercing mandrel between the rolls;

stands;

means for advancing the billet over the piercing mandrel;

pass-closing guide elements, one of swivelably and displaceably arranged between the stands so that a clear distance between the guide elements is adjustable in a plane of the guide elements in relation to a diameter of the round steel;

stand elements arranged to support the guide elements between the stands; and means for applying force to one of the guide elements so as to reduce the clear distance, the force applying means being arranged at the one guide element.

3. A device according to claim 2, wherein the force applying means includes a pretensionable spring assembly.

4. A device according to claim 2 wherein the force applying means includes a hydraulically operating piston-cylinder unit.

5. A device according to claim 2, wherein the force applying means includes a pneumatically operating piston-cylinder unit.

6. A device according to claim 2 wherein the force applying means has a progressive adjustment characteristic.

* * * * *